US010450175B2

(12) United States Patent
Mast

(10) Patent No.: US 10,450,175 B2
(45) Date of Patent: Oct. 22, 2019

(54) SYSTEM FOR HOLDING CABINETS IN PLACE DURING INSTALLATION

(71) Applicant: Jason Mast, Crossville, TN (US)

(72) Inventor: Jason Mast, Crossville, TN (US)

( * ) Notice: Subject to any disclaimer, the term of this patent is extended or adjusted under 35 U.S.C. 154(b) by 600 days.

(21) Appl. No.: 15/216,750

(22) Filed: Jul. 22, 2016

(65) Prior Publication Data

US 2017/0022037 A1 Jan. 26, 2017

Related U.S. Application Data

(60) Provisional application No. 62/196,502, filed on Jul. 24, 2015.

(51) Int. Cl.
*B66F 3/24* (2006.01)
*B66F 1/04* (2006.01)

(52) U.S. Cl.
CPC ..... *B66F 3/247* (2013.01); *B66F 1/04* (2013.01)

(58) Field of Classification Search
CPC ..... B66F 3/247; B66F 1/04
USPC ..... 254/2 B; 269/17
See application file for complete search history.

(56) References Cited

U.S. PATENT DOCUMENTS 923,593 A * 6/1909 Sprado ..... B66F 3/247 254/126
2,939,590 A * 6/1960 Henry ..... B66C 23/48 414/11
4,482,130 A * 11/1984 Paredes ..... B66F 15/00 254/8 R
4,531,720 A * 7/1985 Soder ..... B23Q 1/52 269/208
5,135,205 A * 8/1992 Bedard ..... B25H 1/0007 254/100
5,141,211 A * 8/1992 Adams, Jr. ..... B25H 3/06 269/16
5,375,963 A * 12/1994 Wohlwend ..... B66C 23/48 212/203
5,791,639 A * 8/1998 Johnston ..... E04B 9/345 269/41
6,220,573 B1 * 4/2001 Bromberek ..... B25H 1/0007 254/133 A
6,257,552 B1 * 7/2001 Crow ..... B66F 3/24 254/134
8,672,729 B2 * 3/2014 Boisjoli ..... B24B 29/04 254/2 R
2009/0304488 A1 * 12/2009 Becker ..... B66C 1/40 414/739
2015/0251881 A1 * 9/2015 Grodaes ..... B66C 23/485 254/2 B

* cited by examiner

*Primary Examiner* — Gerald McClain

(74) *Attorney, Agent, or Firm* — Jacob M. Ward; Ward Law Office LLC

(57) ABSTRACT

A lifting system includes a base and an upright extending from the base. An articulating arm assembly is coupled to the upright. The articulating arm assembly has a platform coupled thereto. The lifting system further includes a prime mover. The prime mover engages the articulating arm assembly to elevate the platform to a desired height.

11 Claims, 5 Drawing Sheets

SYSTEM FOR HOLDING CABINETS IN PLACE DURING INSTALLATION

CROSS-REFERENCE TO RELATED APPLICATIONS

This application claims the benefit of U.S. Provisional Application No. 62/196,502, filed on Jul. 24, 2015. The entire disclosure of the above application is hereby incorporated herein by reference.

FIELD

The disclosure generally relates to a cabinet installation system and, in particular, a lifting system that supports and maintains cabinets in a desired position to facilitate installation of the cabinets.

BACKGROUND

Installing cabinets to elevated positions on walls and ceilings can be an unwieldy, hazardous, or laborious task. Typically, when installing elevated cabinets, more than one person is needed. For example, in certain scenarios, one or more persons holds a cabinet workpiece up to the wall or ceiling while another person secures the cabinet workpiece to a desired location on the wall or ceiling. This can be time consuming and costly, especially if a large quantity of cabinets are to be installed at varying elevated positions.

Additionally, in many instances, cabinets are heavy and bulky. Since the cabinets are heavy and bulky, certain practices for installing cabinets can be ergonomically unsound. Furthermore, certain practices for installing cabinets are complex and may not result in the cabinets being installed at a desired level of quality and precision. Since cabinets may need to be installed in multiple areas and/or in confined spaces or rooms, certain tools or apparatuses used for installing cabinets may not be easily transportable to and from and/or fit in certain areas.

Accordingly, there is a continuing need for a system that minimizes complexity and cost of installing cabinets while maximizing quality and precision of installation. Desirably, the system is ergonomically enhanced, safe to use, and readily transportable and adjustable to accommodate a variety of installation parameters.

SUMMARY

In concordance with the instant disclosure, a lifting system that minimizes complexity and cost of installing cabinets while maximizing quality and precision of installation that is ergonomically enhanced, safe to use, and readily adjustable to accommodate a variety of installation parameters has surprisingly been discovered.

In one embodiment, a lifting system includes a base and an upright extending from the base. An articulating arm assembly is coupled to the upright. The articulating arm assembly has a platform coupled thereto. A prime mover engages the articulating arm assembly to elevate the platform to a desired height.

In another embodiment, a transportable lifting system is disclosed. The lifting system includes a base having a plurality of castors disposed thereon. An upright extends outwardly from the base. A pneumatically moveable articulating arm assembly is pivotally coupled to the upright. The articulating arm assembly has a platform coupled thereto and selectively moves between a retracted arrangement and an extended arrangement.

In yet another embodiment, a method of lifting a cabinet for installation includes the step of providing a lifting system including a base and an upright extending from the base. The lifting system including an articulating arm assembly extending from the upright. The articulating arm assembly having a platform coupled thereto. The method additionally includes the steps of moving the platform adjacent an installation surface, positioning the cabinet on the platform, and adjusting the articulating arm assembly to position and align the cabinet relative to the installation surface.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
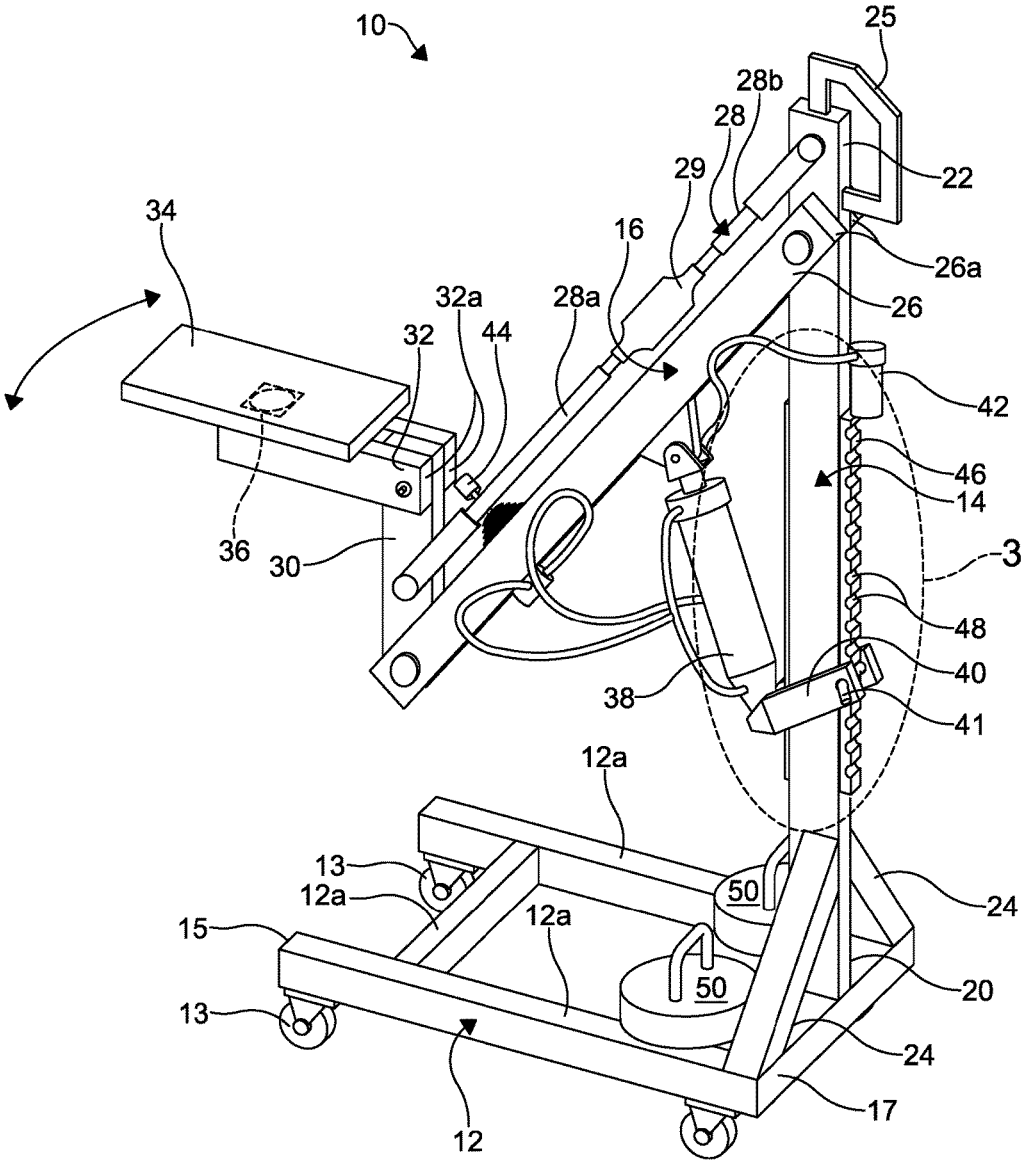
FIG. 1 shows a left side perspective view of a lifting system in a retracted arrangement according to an embodiment of the present disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Figure 2:
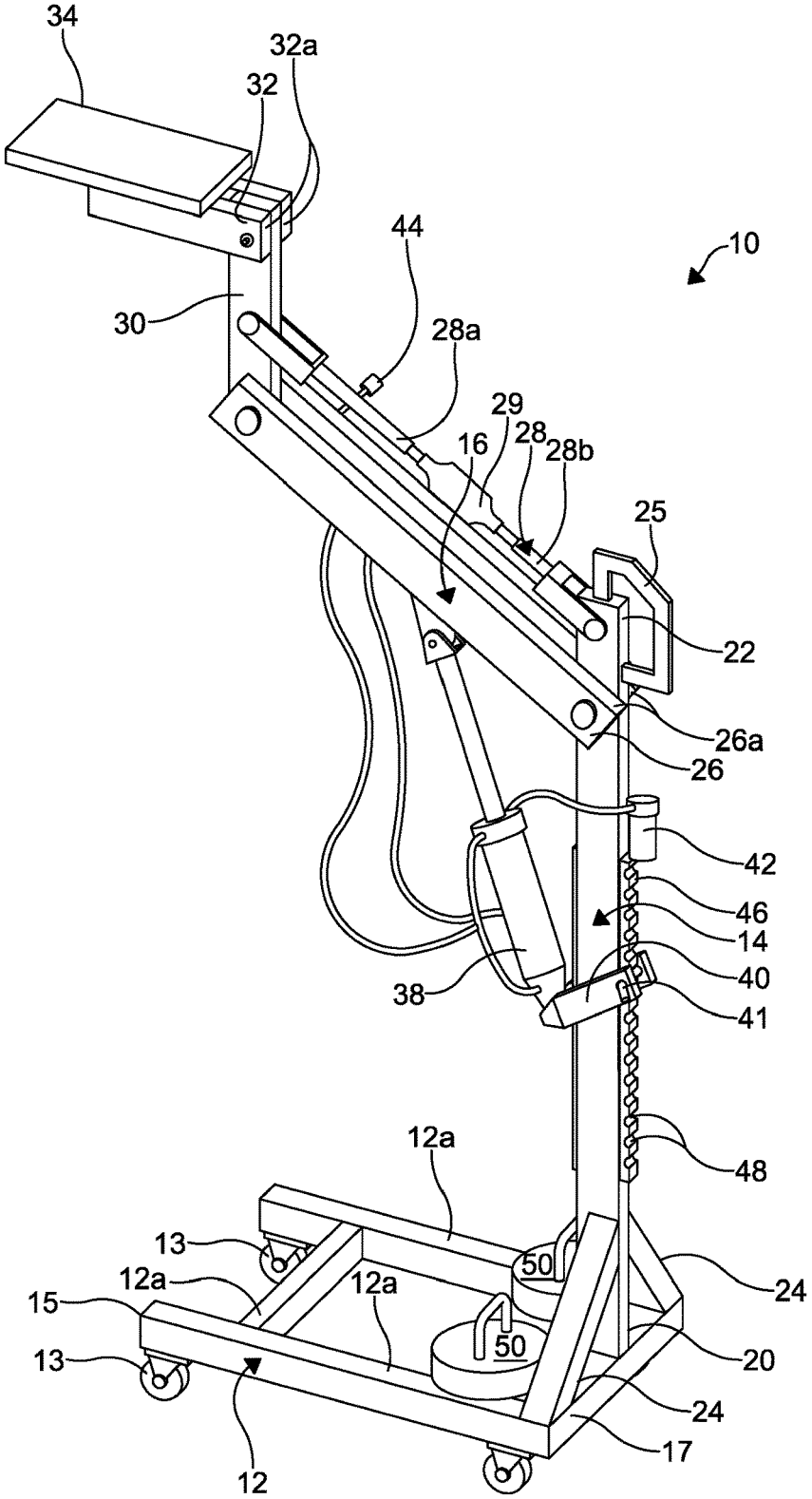
FIG. 2 shows a left side perspective view of a lifting system in an elevated arrangement according to an embodiment of the present disclosure.
Figure 3:
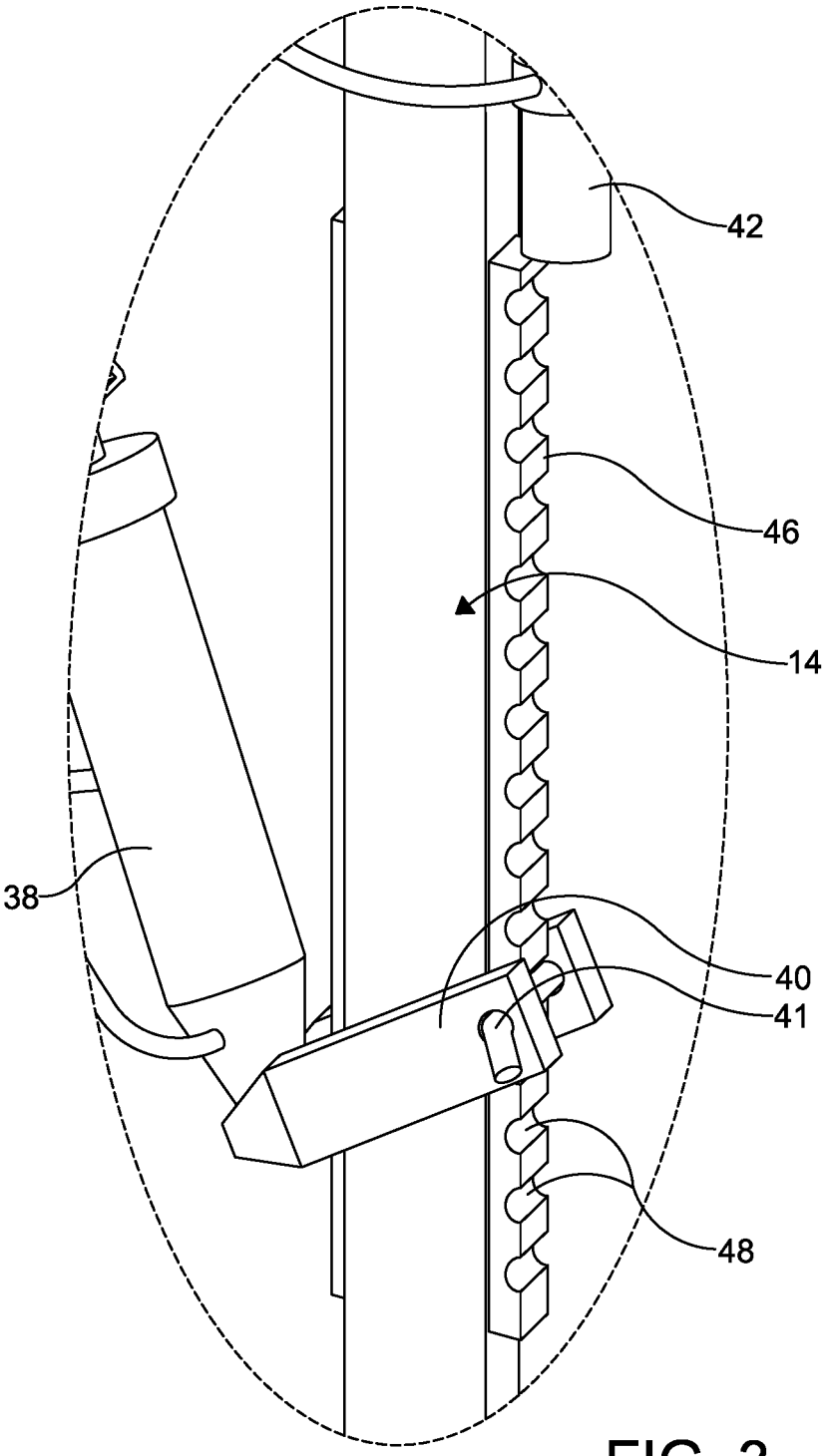
FIG. 3 shows an enlarged left side perspective view of a height adjustment assembly of the lifting system of FIG. 1, highlighted by circle 3.

FIGS. 1-3 illustrate a lifting system 10 according to the present disclosure. The lifting system 10 facilitates lifting and maintaining cabinets (not shown) in a desired position during installation of the cabinets. The lifting system 10 is adjustable between a retracted arrangement (shown in FIGS. 1 and 3) and an extended arrangement (shown in FIG. 2). The extended arrangement is used for lifting the cabinets to, and maintaining the cabinets at, a desired elevated position. The retracted arrangement is used for positioning the cabinets on the lifting system 10. It is understood that the lifting system 10 can be used to lift other articles aside from cabinets without departing from the nature and scope of the present disclosure.

The lifting system 10 includes a base 12, an upright 14, and an adjustable articulating arm assembly 16 configured to lift and maintain the cabinet to a desired elevated position. The base 12 includes a plurality of base members **12*a* coupled to each other forming a framework structure having a substantially rectangular shape. However, the base 12 can have other shapes and configurations, as desired. For example, the base 12** can be triangular or formed from a continuous piece of material.

The base 12 includes a first end 15 and a second end 17. In exemplary embodiments, during installation, the first end 15 is adapted or configured to be the end aligned or positioned proximate to and facing towards an installation surface. The second end 17 is adapted or configured to be the end aligned opposite from or facing away from the installation surface. In certain scenarios, the base member 12*a* forming the first end 15 and the base member 12*a* forming the second end 17 may be disposed substantially parallel with the installation surface. However, in other examples, the base member 12*a* forming the first end 15 and the base member 12*a* forming the second end 17 can be disposed perpendicular to the installation surface such that sides are parallel with the installation surface. Additionally, the base member 12*a* forming the first end 15 and the base member 12*a* forming the second end 17 can be disposed at an angle to the installation surface.

The base 12 further includes a plurality of castors 13 coupled thereto. The term "castors" is used herein to generally describe any types of transporting devices used to facilitate movement and transportability of devices such as wheels, bearings, mechanical castors, sliding or slip mechanisms or materials that minimize friction. In the embodiments illustrated, four castors 13 are coupled to the corners of the base 12 to facilitate transportability of the lifting system 10. However, more or fewer than four castors 13 can be coupled to any portion of the base 12 as desired. In a non-limiting example, the castors 13 are swivel locking castors that can be locked to militate against movement of the lifting system 10 when moved to a desired position. However, the castors 13 can be any type of castor now known or later developed.

The upright 14 has a first end 20 and a second end 22. The first end 20 of the upright 14 is coupled to the base 12. The upright 14 extends substantially perpendicularly from the base 12, for example. In the embodiment illustrated, the upright 14 extends from the base 12 at the second end 15 of the base 12. The upright 14 can be coupled to the base 12 by a welding process. However, other suitable means and processes of coupling are contemplated and can be employed such as bolts, pins, and press-fitting, for example.

In the embodiment illustrated, braces 24 extend between the base 12 and a portion of the upright 14 intermediate the ends 20, 22 of the upright 14 to support and stabilize the upright 14. A handle 25 is disposed at the second end 22 of the upright 14 to facilitate transporting the lifting system 10. In other embodiments, the handle 25 can be disposed at other portions of the upright 14 or lifting system 10, as desired.

The articulating arm assembly 16 is pivotally coupled to the second end 22 of the upright 14 and rotates about the upright 14. The articulating arm assembly 16 includes a primary link 26, an alignment link 28, an alignment member 30, a platform support 32, and a rotatable platform 34. The primary link 26 extends from the upright 14, and connects the upright 14 to the alignment member 30. A pair of parallel cross members 26*a* may form the primary link 26, for example, and cooperate with each other to form a channel therebetween. The cross members 26*a* are spaced from each other to form the channel. The channel is adapted to receive a portion of the upright 14 and a first end of the alignment member 30, so that the primary link 26 is rotatable or pivotable relative to the upright 14. For example, a post, pin, bolt or similar coupling means may be disposed through aligned holes formed in both the cross members 26*a* and the upright 14, to pivotally connect the primary link 26 to the upright 14.

The alignment member 30 extends between and connects the primary link 26 and the platform support 32. In non-limiting embodiments, the alignment member 30 is pivotally coupled to the primary link 26 and rigidly coupled to the platform support 32. The alignment member 30 maintains a position substantially perpendicular to the platform support 32 from the retracted arrangement to the extended arrangement.

The platform support 32 is formed from a pair of support members 32*a* cooperating with each other to form a channel therebetween. The support members 32*a* are spaced from each other to form the channel. The channel of the platform support 32 is adapted to receive a second end of the alignment member 30. For example, a post, pin, bolt or similar coupling means may be disposed through aligned holes formed in both the support members 32*a* and the alignment member 30, to connect the alignment member 30 to the support members 32*a*.

The platform 34 extends along a plane substantially parallel to an upper surface of the platform support 32. The platform 34 is rotatably coupled to the platform support 32 and can rotate at an angle of 360 degrees with respect to the platform support 32. In the exemplary embodiment illustrated, the platform 34 is rotatably coupled to the platform support 32 by a swivel plate 36 (shown in FIG. 1). The swivel plate 36 may be a turntable of the "Lazy Susan" type, or another type of rotatable mount. For example, the swivel plate 36 may have a pair of spaced apart plate members with bearings disposed therebetween, for example, in a channel of a lower plate member, to permit a top plate member of the swivel plate 36 to rotate 360 degrees. However, other types of swivel plates, and means of rotatably coupling the platform 34 to the platform support 32, can be employed.

The alignment link 28 extends between the second end 22 of the upright 14 and a portion of the alignment member 30 intermediate the first end and the second end of the alignment member 30. The alignment link 28 is parallel to and spaced at a distance from the primary link 26. The alignment link 28 includes a first section 28*a* and a second section 28*b* coupled to each other by an adjustable coupling 29.

The adjustable coupling 29 selectively maintains the first section 28*a* and the second section 28*b* at a distance from each other. In certain embodiments, the adjustable coupling 29 has threaded interior portions engaging with exterior threaded portions of each of the sections 28*a*, 28*b*. The adjustable coupling 29 selectively rotates permitting axial movement of the sections 28*a*, 28*b*. In a first rotational direction of the adjustable coupling 29, the sections 28*a*, 28*b* move axially towards each other causing a length of the alignment link 28 to decrease. As the length of the alignment link 28 decreases, an angle formed by the relative orientations of the primary link 26 and alignment member 30 will likewise decrease. In a second rotational direction of the adjustable coupling 29, the sections 28*a*, 28*b* move axially away from each other causing the length of the alignment link 28 to increase. As the length of the alignment link 28 increases, an angle formed by the relative orientations of the primary link 26 and alignment member 30 will likewise increase. In this manner, the adjustable coupling 29 can be employed to manually fine tune a placement and level of the cabinet when disposed on the platform 34.

As shown in FIGS. 1-2, a prime mover is used to selectively move the primary link 26 between the lowered position (FIG. 1) in the retracted arrangement and a lifted position (FIG. 2) in the extended arrangement. Although shown herein as a pneumatic cylinder 38, it should be appreciated that any other type of prime mover such as electric actuators and hydraulic actuators may also be employed within the scope of the disclosure.

The pneumatic cylinder 38 extends between the upright 14 and the primary link 26. The cylinder 38 utilizes air to cause linear movement of a piston rod. A piston rod end of the cylinder 38 is coupled to the primary link 26. An opposing end of the cylinder 38 is coupled to the upright 14 by an adjustment bracket 40. The cylinder 38 receives the air from a compressed air source separate from the lifting system 10. The cylinder 38 is coupled to the compressed air source via a plurality of lines and connectors.

In certain embodiments, a filter 42 such as a separator is coupled to the lifting system 10 upstream of the cylinder 38. A controller 44 for activating the cylinder 38 is coupled to the lifting system 10 and in pneumatic and/or signal communication with the cylinder 38. When actuated, the piston rod of the cylinder 38 extends from the cylinder 38 and applies force to the primary link 26. The primary link 26 pivots so that an angle formed between the primary link 26 and the upright 14 increases, which causes a height of the platform 34 to increase.

As more clearly shown in FIG. 3, the adjustment bracket 40 includes a pin 41 extending therethrough. The pin 41 engages with a height adjustment track 46 disposed along a height of the upright 14. The height adjustment track 46 includes a plurality of notches 48 formed therein. The pin 41 can be received in any of the notches 48 to adjust a height of the adjustment bracket 40 and a height of the cylinder 38, and accordingly, a height of the platform 34. The adjustment bracket 40 and the height adjustment track 46 form a height adjustment assembly. The height adjustment assembly can be employed to adjust the height of the platform 34 in addition to the activation of the cylinder 38 or independently from the activation of the cylinder 38.

With renewed reference to FIGS. 1-2, the lifting system 10 can include counterweights 50 disposed thereon. The counterweights 50 can have any weight as desired to militate against a tipping force of the lifting system 10 when in use. Bumpers (not shown) can be included with the lifting system 10 to militate against damage to the lifting system 10 and/or installation surfaces. For example, bumpers can be positioned along the exterior portions of base 12.

In operation, the lifting system 10 is transported to a location adjacent the installation surface for installing the cabinets. For example, the first end 15 of the base 12 may be positioned towards and adjacent the installation surface such that the platform 34 is proximate the installation surface. The compressed air source is coupled to the lifting system 10. The cabinets are positioned on the platform 34 when the lifting system 10 is in the retracted arrangement. In the retracted arrangement, the piston rod of the cylinder 38 is retracted so the height of the platform 34 is lowered. The controller 44 is employed to actuate the cylinder 38. When the cylinder 38 is actuated, the piston rod extends outwardly therefrom causing the primary link 26 to pivot upwardly. As the primary link 26 pivots, the height of the platform 34 increases until the cabinets reach a desired elevation.

The adjustable coupling 29 is rotated to selectively adjust a length of the alignment link 28. The length of the alignment link 28 is adjusted to level the platform 34 to a position substantially perpendicular to the installation surface. For example, the adjustable coupling 29 may be manually rotated until the cabinet is plumb or flush with a wall surface. The height of the platform 34 can be further increased by adjusting the adjustable bracket 40 in relation to the height adjustment track 46 by placing the pin 41 in the desired one of the notches 48. The platform 34 can be rotated as desired to adjust placement of the cabinets. The counterweights 50 militate against a tilting of the lifting system 10 when the cabinets are positioned on the lifting system 10

Advantageously, the lifting system 10 can be easily transported to a desired location for cabinet installation. The lifting system 10 minimizes man power that may be required for cabinet installation, minimizes complexity of installation, and improves safety of cabinet installation. Additionally, the lifting system 10 compensates for installation surfaces that are not level and facilitates accuracy and quality of installation.

Figure 4:
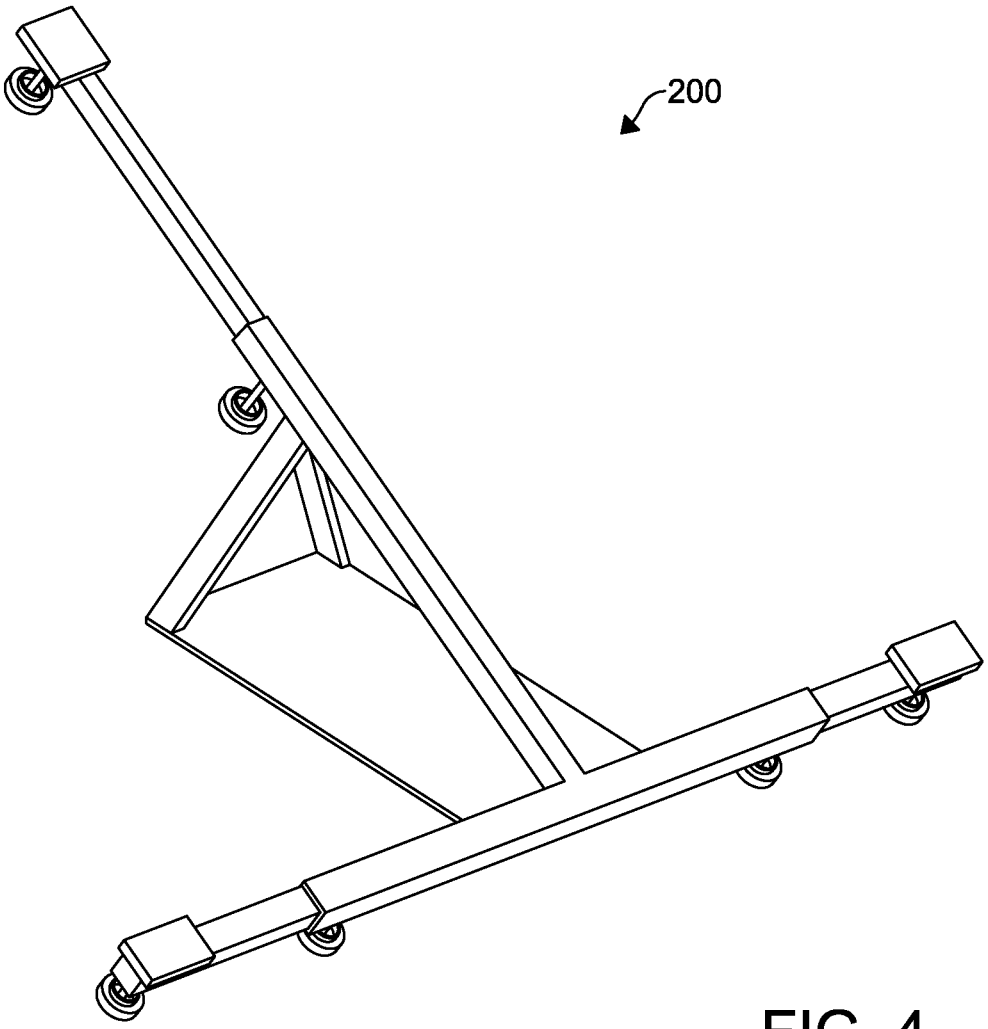
FIG. 4 shows a perspective view of a first attachment for the lifting system shown in FIGS. 1-3, and configured to hold a car hood.
Figure 5:
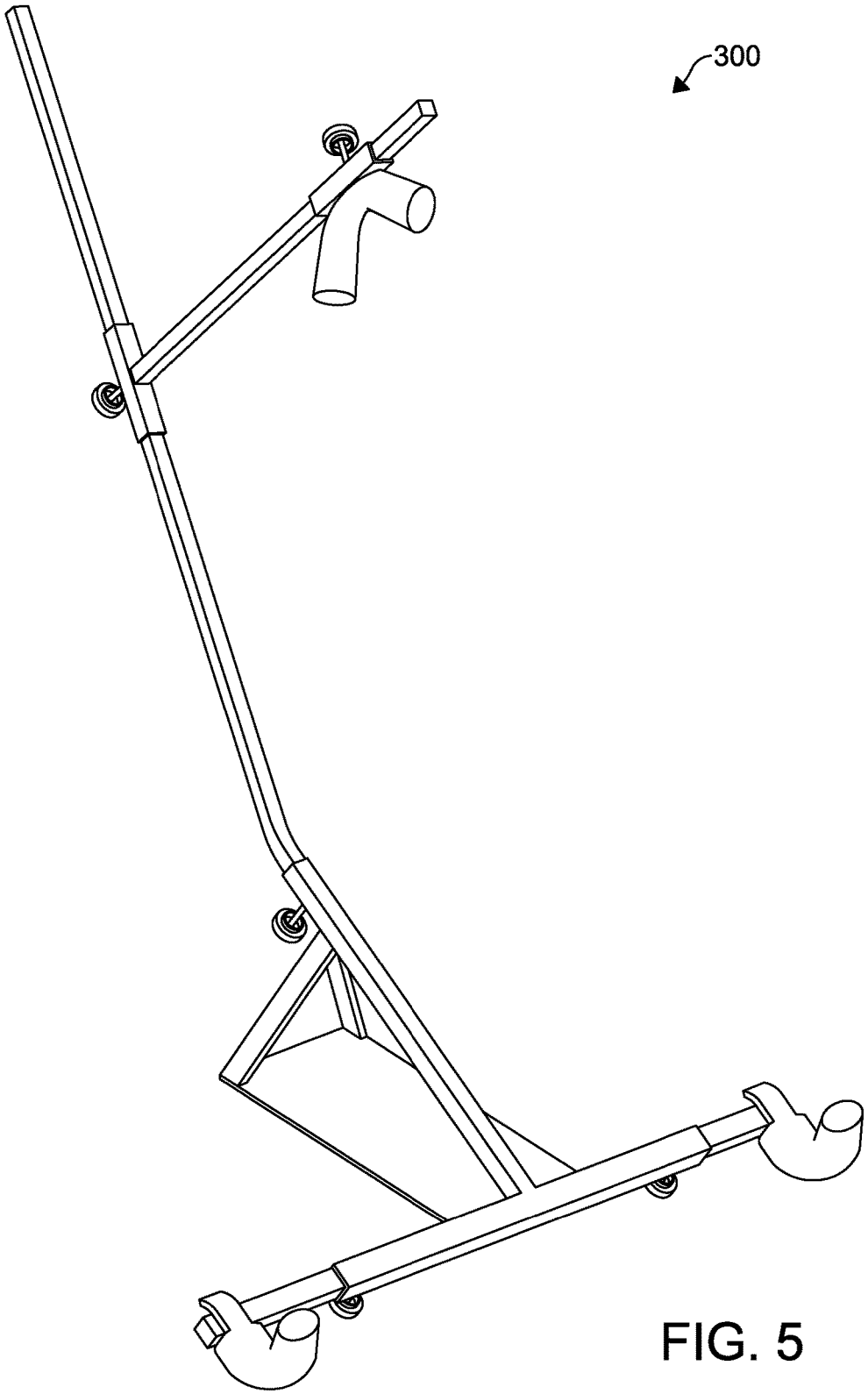
FIG. 5 shows a perspective view of a second attachment for the lifting system shown in FIGS. 1-3, and configured to hold a car door.

With respect to FIGS. 4-5, a first attachment 200 and a second attachment 300 for the lifting system 10 are also shown. Each of the first attachment 200 and the second attachment 300 may be selectively affixed to the platform support 32 or the platform 34, as desired. In FIG. 4, the first attachment 200 is advantageously configured to hold a car hood. In FIG. 5, the second attachment 300 is advantageously configured to hold a car door. Other suitable attachments with other configurations may also be used with the lifting system 10, to accommodate a variety of different uses, as desired.

While certain representative embodiments and details have been shown for purposes of illustrating the invention, it will be apparent to those skilled in the art that various changes may be made without departing from the scope of the disclosure, which is further described in the following appended claims.

What is claimed is:

1. A lifting system for installation of cabinets, comprising:

a base;

an upright coupled to and disposed above the base, the upright having a height adjustment track with a plurality of notches;

an articulating arm assembly coupled to the upright, the articulating arm assembly having a primary link including a pair of parallel cross members that cooperate with each other to form a channel therebetween, an alignment bar, a platform support, an alignment link, a swivel plate, and a platform, each of the primary link and the alignment link pivotably attached to the upright and to the alignment bar, the alignment bar disposed in the channel between the pair of parallel cross members, the alignment link having a first section, a second section, and an adjustable coupling, the adjustable coupling disposed between and threadably attached to the first section and the second section and permitting for a manual axial movement of the first section and the second section by manual rotation of the adjustable coupling to adjust a length of the alignment link to level the platform, the platform support connected to the alignment bar, the alignment bar rigidly coupled to and oriented substantially perpendicular with the platform support, and the swivel plate disposed between and connecting the platform support and the platform, the platform being manually rotatable 360 degrees on the swivel plate a prime mover selectively moveably coupled to the height adjustment track by way of an adjustment bracket with a pin, wherein the pin is selectively engaged with one of the plurality of notches of the height adjustment track for a manual selection of an elevation of the platform; and a controller in communication with the prime mover and configured for selectively controlling a movement of the articulating arm assembly between a retracted arrangement and an extended arrangement by the prime mover.

2. The lifting system of claim 1, wherein the prime mover is a pneumatic cylinder.

3. The lifting system of claim 1, wherein the base includes a plurality of castors coupled thereto.

4. The lifting system of claim 1, further comprising a handle disposed on the upright configured to facilitate transportation of the lifting system.

5. The lifting system of claim 1, wherein the base has a first end and a second end, the upright coupled to the base at the second end of the base and the articulating arm assembly extending from the upright towards the first end of the base.

6. The lifting system of claim 5, further comprising a counter weight disposed on the base proximate the second end of the base.

7. The lifting system of claim 1, wherein the base is substantially rectangular shaped.

8. A method of lifting a cabinet for installation comprising the steps of:

providing a lifting system including a base, an upright coupled to and disposed above the base, the upright having a height adjustment track with a plurality of notches, an articulating arm assembly coupled to the upright, the articulating arm assembly having a primary link including a pair of parallel cross members that cooperate with each other to form a channel therebetween, an alignment bar, a platform support, an alignment link, a swivel plate, and a platform, each of the primary link and the alignment link pivotably attached to the upright and to the alignment bar, the alignment bar disposed in the channel between the pair of parallel cross members, the alignment link having a first section, a second section, and an adjustable coupling, the adjustable coupling disposed between and threadably attached to the first section and the second section and permitting for a manual axial movement of the first section and the second section by manual rotation of the adjustable coupling to adjust a length of the alignment link to level the platform, the platform support connected to the alignment bar, the alignment bar rigidly coupled to and oriented substantially perpendicular with the platform support, and the swivel plate disposed between and connecting the platform support and the platform, the platform being manually rotatable 360 degrees on the swivel plate, a prime mover selectively moveably coupled to the height adjustment track by way of an adjustment bracket with a pin, wherein the pin is selectively engaged with one of the plurality of notches of the height adjustment track for a manual selection of an elevation of the platform, and a controller in communication with the prime mover and configured for selectively controlling a movement of the articulating arm assembly between a retracted arrangement and an extended arrangement by the prime mover;

moving the platform adjacent an installation surface;

positioning the cabinet on the platform; and adjusting the articulating arm assembly to position and align the cabinet relative to the installation surface.

9. The method of claim 8, wherein the prime mover is a pneumatic cylinder, and the articulating arm assembly is pneumatically adjusted with the pneumatic cylinder.

10. The method of claim 8, further comprising a step of adjusting the elevation of the platform by moving the pin to engage with a different one of the plurality of notches of the height adjustment track.

11. The method of claim 8, further comprising a step of leveling the platform by adjusting the length of the alignment link.

* * * * *